US012235080B2

(12) United States Patent
Cerovic et al.

(10) Patent No.: US 12,235,080 B2
(45) Date of Patent: Feb. 25, 2025

(54) SOUND REDUCING SYSTEMS FOR USE WITH PROJECTILE LAUNCHERS

(71) Applicant: Wrap Technologies, Inc., Tempe, AZ (US)

(72) Inventors: Milan Cerovic, Tempe, AZ (US); David Richter, Tempe, AZ (US); Dubravko Zekanovic, Tempe, AZ (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

(21) Appl. No.: 18/184,593

(22) Filed: Mar. 15, 2023

(65) Prior Publication Data

US 2023/0296357 A1 Sep. 21, 2023

Related U.S. Application Data

(60) Provisional application No. 63/320,505, filed on Mar. 16, 2022.

(51) Int. Cl.

| | |
|---|---|
| ***F42B 14/06*** | (2006.01) |
| ***F41H 13/00*** | (2006.01) |
| ***F42B 5/03*** | (2006.01) |
| ***F42B 12/66*** | (2006.01) |

(52) U.S. Cl.

CPC ..... *F41H 13/0006* (2013.01); *F42B 5/03* (2013.01); *F42B 12/66* (2013.01)

(58) Field of Classification Search

CPC .. F41H 13/0006; F41H 13/0025; F42B 12/68; F42B 12/66; F42B 11/62; F42B 23/10; F41B 15/10

See application file for complete search history.

(56) References Cited

U.S. PATENT DOCUMENTS

| | | | | |
|---|---|---|---|---|
| 39,180 A * | 7/1863 | Stafford | ..... | F42B 14/064 102/522 |
| 42,268 A * | 4/1864 | Boekel | ..... | F42B 14/064 102/520 |
| 405,690 A * | 6/1889 | Ball | ..... | F42B 14/064 86/52 |

(Continued)

OTHER PUBLICATIONS

International Search Report for Serial No. PCT/US 23/64471 dated Jan. 11, 2024, 11 pages.

*Primary Examiner* — Derrick R Morgan

(74) *Attorney, Agent, or Firm* — Thorpe, North & Western; Jason R. Jones

(57) ABSTRACT

A cassette for deploying one or more entangling projectiles includes a pair of sockets, each socket being in fluid communication with a pressure source. An entangling projectile includes a pair of anchors connected by a tether, each of the pair of anchors being positionable within one of the sockets and the tether being carried by the cassette. Each socket carries a slidable piston positionable in a respective socket between an entangling projectile and the pressure source such that each slidable piston is propelled along a respective socket in response to a pressure wave generated by the pressure source to thereby expel the anchor from the socket. Each of a pair of retaining clips is engageable with an anchor and with a socket to aid in retaining the respective anchor in the respective socket prior to generation of the pressure wave.

16 Claims, 10 Drawing Sheets

(56) References Cited

U.S. PATENT DOCUMENTS 2,669,930 A * 2/1954 Darby ..... F42B 14/064 102/523
2,993,444 A * 7/1961 Hablutzel ..... F42B 14/068 102/523
3,507,221 A * 4/1970 Grolly ..... F42B 14/064 102/518
3,621,781 A * 11/1971 Johnsen ..... F42B 5/08 102/439
3,714,900 A * 2/1973 Feldmann ..... F42B 14/064 102/522
3,745,926 A * 7/1973 Mertz ..... F42B 10/08 102/703
3,771,458 A * 11/1973 Schweimler ..... F42B 14/064 102/523
3,802,345 A * 4/1974 La Costa ..... F42B 5/03 42/78
3,847,082 A * 11/1974 Feldmann ..... F42B 14/064 102/522
4,043,269 A * 8/1977 Ambrosini ..... F42B 12/38 102/513
4,253,132 A * 2/1981 Cover ..... F41H 13/0006 361/232
4,590,862 A * 5/1986 Grabarek ..... F42B 14/064 102/703
4,676,169 A * 6/1987 Maki ..... F42B 5/02 102/501
4,735,148 A * 4/1988 Holtzman ..... F42B 14/064 102/522
4,800,816 A * 1/1989 Meyer ..... F42B 14/064 102/523
5,164,539 A * 11/1992 French ..... F42B 14/064 102/520
5,315,932 A 5/1994 Bertram
5,460,155 A * 10/1995 Hobbs ..... F42B 12/68 124/56
5,698,815 A * 12/1997 Ragner ..... F41H 13/0006 102/504
7,412,975 B2 * 8/2008 Dillon, Jr. ..... F41B 11/62 102/440
7,950,329 B1 * 5/2011 Nemtyshkin ..... F42B 12/36 102/504
8,205,537 B1 * 6/2012 Dupont ..... F41H 13/0006 102/504
8,601,928 B2 * 12/2013 Martinez ..... F42B 12/40 114/317
8,857,305 B1 * 10/2014 Tseng ..... F41B 15/10 124/71
8,896,982 B2 * 11/2014 Beechey ..... F41H 13/0018 102/504
8,899,139 B2 * 12/2014 Brill ..... F41A 21/06 89/1.41
9,377,276 B1 * 6/2016 Jiang ..... F41H 13/0006
10,036,615 B2 7/2018 Norris et al.
10,288,388 B1 * 5/2019 Lavin ..... F41H 13/0025
10,551,152 B2 * 2/2020 Norris ..... F42B 5/03
10,942,012 B2 * 3/2021 Sun ..... F41B 11/62
11,156,432 B1 10/2021 Klug et al.
11,313,655 B1 * 4/2022 Han ..... F42B 14/02
11,371,810 B2 * 6/2022 Norris ..... F41B 15/10
11,828,572 B2 * 11/2023 Lavin ..... F41H 13/0025
2003/0010184 A1 * 1/2003 McNulty, Jr. ..... F41H 13/0025 42/1.13
2014/0063679 A1 * 3/2014 Park ..... F41H 13/0025 361/232
2017/0160060 A1 * 6/2017 Purvis ..... F41H 13/0006
2017/0276460 A1 9/2017 Norris et al.
2018/0283829 A1 * 10/2018 Petrovic ..... F41H 13/0025
2020/0018583 A1 * 1/2020 Norris ..... F41B 15/10
2020/0278182 A1 * 9/2020 Salisbury ..... F41H 13/0025
2020/0284556 A1 * 9/2020 Nemtyshkin ..... F41H 13/0025
2020/0333116 A1 10/2020 Norris et al.
2021/0254954 A1 * 8/2021 Billings ..... F41A 21/18
2022/0074714 A1 3/2022 Norris
2022/0260345 A1 8/2022 Cerovic et al.
2022/0276027 A1 * 9/2022 Petrovic ..... F41H 13/0025
2023/0296358 A1 9/2023 Cerovic et al.
2023/0375312 A1 11/2023 Cerovic et al.

* cited by examiner

SOUND REDUCING SYSTEMS FOR USE WITH PROJECTILE LAUNCHERS

PRIORITY CLAIM

Priority is claimed of and to U.S. Provisional Patent Application Ser. No. 63/320,505, filed Mar. 16, 2022, which is hereby incorporated herein by reference in its entirety.

BACKGROUND OF THE INVENTION

Field of the Invention

The present invention relates generally to propulsion systems for use with entangling projectile launching systems.

Related Art

It has been recognized for some time that police and military personnel can benefit from the use of devices other than firearms to deal with some hostile situations. To address this need, the present applicant developed a commercially successful product known as the BolaWrap®. This device, and others developed by the present applicant, have allowed law enforcement personnel to address potentially dangerous situations without resorting to the use of a firearm, and without engaging in hand-to-hand combat.

This type of launching system generally utilizes a projectile that includes a tether and a pair of anchors or pellets carried at ends of the tether. The projectile is expelled from a launcher at very high speeds by utilizing a pressure source, such as a cartridge containing a propellant. For more background on the general concept of entangling projectiles, the reader is directed U.S. Pat. No. 10,107,599, which is hereby incorporated herein by reference to the extent it is consistent with the teachings herein.

While the BolaWrap® systems have enjoyed widespread success, the present applicant has continued to develop technology to even further improve the operation and acceptance of such devices.

SUMMARY OF THE INVENTION

In accordance with one aspect of the invention, a cassette for deploying one or more entangling projectiles is provided. The cassette can include a pair of sockets, each socket being in fluid communication with a pressure source. An entangling projectile can include a pair of anchors connected by a tether, each of the pair of anchors being positionable within one of the sockets and the tether being carried by the cassette. Each socket can carry a slidable piston positionable in a respective socket between an entangling projectile and the pressure source such that each slidable piston is propelled along a respective socket in response to a pressure wave generated by the pressure source to thereby expel the anchor from the socket.

In accordance with another aspect of the technology, a cassette for deploying one or more entangling projectiles is provided. The cassette can include a pair of sockets, each socket being in fluid communication with a pressure source. An entangling projectile can include a pair of anchors connected by a tether, each of the pair of anchors being positionable within one of the sockets and the tether being carried by the cassette. Each socket can carry a slidable piston positionable in a respective socket between an entangling projectile and the pressure source such that each slidable piston is propelled along a respective socket in response to a pressure wave generated by the pressure source to thereby expel the anchor from the socket. A pair of retaining clips can each be engageable with an anchor and with a socket to aid in retaining the respective anchor in the respective socket prior to generation of the pressure wave.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 2A:
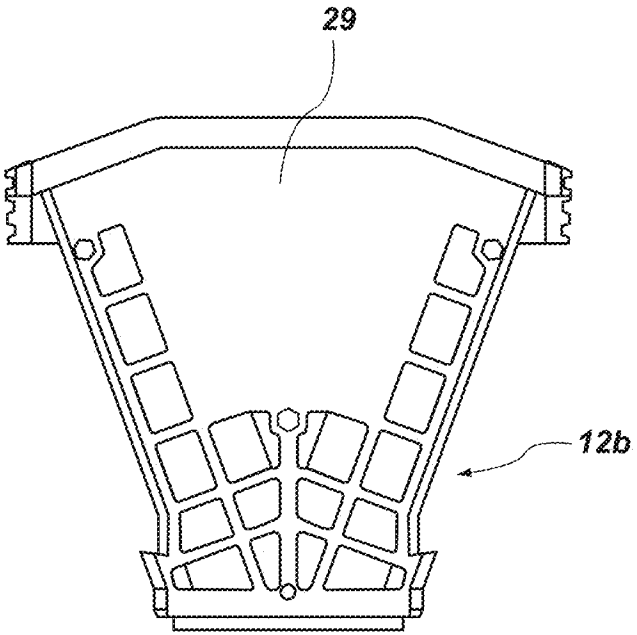
FIG. 2A is a top view of a cassette in accordance with an embodiment of the technology.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a socket" can include one or more of such sockets, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates broadly to components used in non-lethal engagement systems. The present launchers are sometimes referred to as ensnarement or entanglement systems. They can be effectively used as an aid in impeding the movement of or detaining aggressive or fleeing subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity hand-to-hand combat. The technology provides a manner by which the arms or legs of a subject can be temporarily tethered or bound, to the extent that the subject finds it difficult to continue moving in a normal fashion. The present applicant has developed a number of such systems, available commercially under the brand name BolaWrap®.

Figure 1:
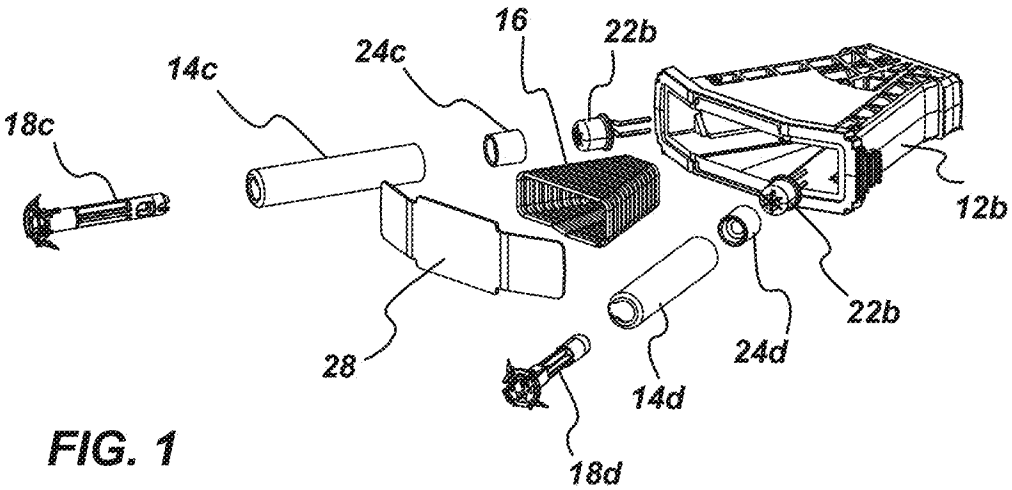
FIG. 1 is a perspective view of a cassette for deploying an entangling projectile in accordance with an embodiment of the technology (note that the tether of the entangling projectile is not shown connected to anchors in this view for clarity)

The present application is directed to such systems that include sound reducing or dampening capability. As shown generally in FIG. 1, a launcher of the present technology can generally utilize a cassette 12*b* that includes pressure source (s) 22*b* that, when activated, generate(s) a high pressure wave. This wave in turn expels a pair of anchors or pellets 18*c*, 18*d*, from a pair of sockets or cylinders 14*c*, 14*d* formed in or carried by the cassette. A tether 16 can connect the anchors, although it is not shown connected in this view to aid in clarity. A shield or cover 28 can be installed over the entire assembly to protect the assembly from dust, moisture, etc.

The system can include a sliding piston 24*c*, 24*d* that is positioned in a respective socket 14*c*, 14*d* upstream of the anchor or pellet 18*c*, 18*d*. When a pressure source 22*b* is activated, the resulting pressure wave contacts the piston and propels the piston along the length of the socket. As the piston is propelled forward it, in turn, propels the anchors or pellets forcefully from the sockets. While the anchors are propelled from the sockets, the sliding piston is prevented from exiting the sockets. In this manner, the sliding piston creates an expansion chamber within the socket that receives the pressurized gas resulting from activation of the pressure source. This in turn greatly reduces the soundwave generated as a result of firing the launcher. In one non-limiting example, the intensity of the soundwave is reduced from about 155 dB to below about 140 dB. In some cases, reduction to about 115-135 dB has been achieved.

In the exemplary figures included herein, only a cassette 12, 12*b*, etc., with its accompanying components is shown. It will be readily understood by one of ordinary skill in the art that such cassettes are but one component of an overall launching system that may appear, for example, similar to other hand-held devices, such as the commercially available BolaWrap® device sold by the Applicant. The overall launching system will likely include one or more power sources, power switch, control circuitry, aiming components, charge indicators, etc. In the interest of clarity, however, the present figures are limited to the components carried on or in the cassette.

FIGS. 2A through 11 illustrate additional embodiments of the technology. In these examples, an electronically initiated pressure source 22*b* (see, for example, FIGS. 2C, 5, 6A, etc.) can be utilized. Such pressure sources can be initiated by providing them with a controlled electrical charge, as will be readily understandable by one of ordinary skill in the art having possession of this disclosure. In some examples, the pressure source includes a microgas generator, which is a commonly available pyrotechnic charge.

Figure 2C:
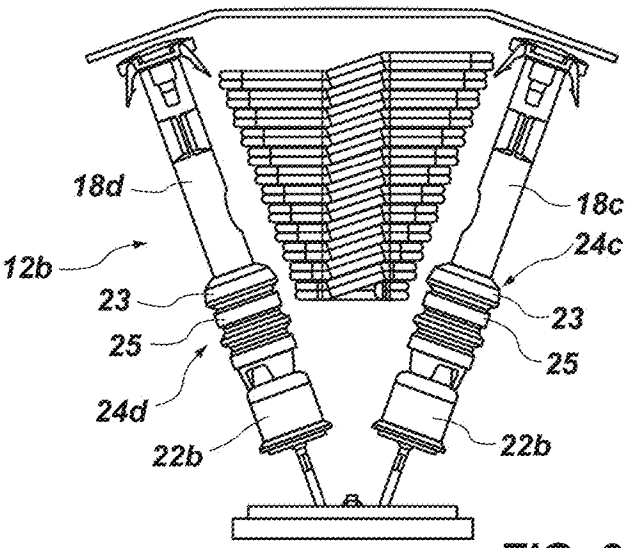
FIG. 2C is a top view of the cassette of FIG. 2B, with the sockets omitted to reveal other components in more detail.
Figure 2E:
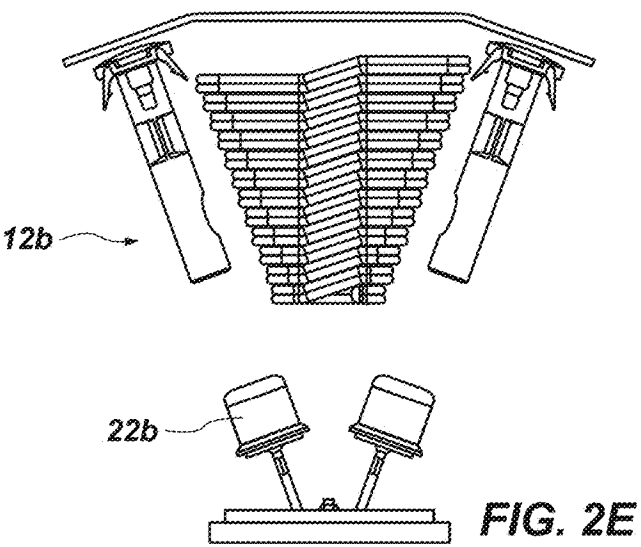
FIG. 2E is a top view of the cassette of FIG. 2D, with a rigid component of the slidable piston omitted to reveal other components in more detail.
Figure 2B:
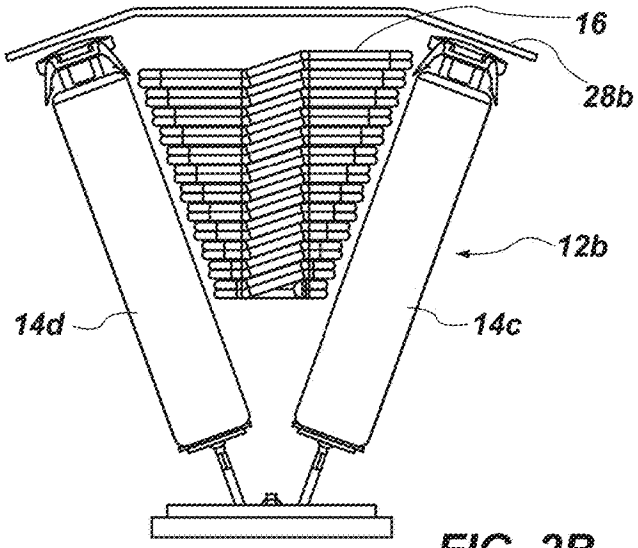
FIG. 2B is a top view of the cassette of FIG. 2A, with the outer casing omitted to reveal other components in more detail.
Figure 2D:
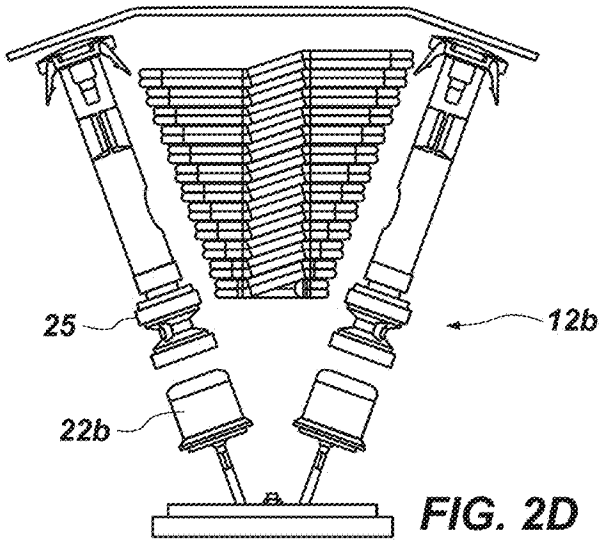
FIG. 2D is a top view of the cassette of FIG. 2C, with a pliable component of a slidable piston omitted to reveal other components in more detail.

FIGS. 2A through 2E show the cassette 12*b* with varying components omitted from each successive view to provide details of previously hidden components. In FIG. 2A, an outer casing 29 is shown that can be formed in a variety of configurations and from a variety of known materials. In FIG. 2B, the outer casing is omitted, revealing a protective shield or cover 28*b*. A tether 16 is shown in the configuration in which it can be stowed within the cassette. A pair of sockets 14*c*, 14*d* are also shown, further details of which are discussed in more detail below.

In FIG. 2C, the sockets are omitted to reveal beneath a pair of anchors 18*c*, 18*d*. As will be appreciated, each socket is in fluid communication with a respective pressure source 22*b*. In addition to the anchors, each socket 14*c*, 14*d* can carry a slidable piston 24*c*, 24*d*. The slidable pistons are positionable in a respective socket between an entangling projectile and the pressure source. In this manner, each slidable piston is propelled along a respective socket in response to a pressure wave generated by the pressure source to thereby expel the anchor from the socket.

Figure 7B:
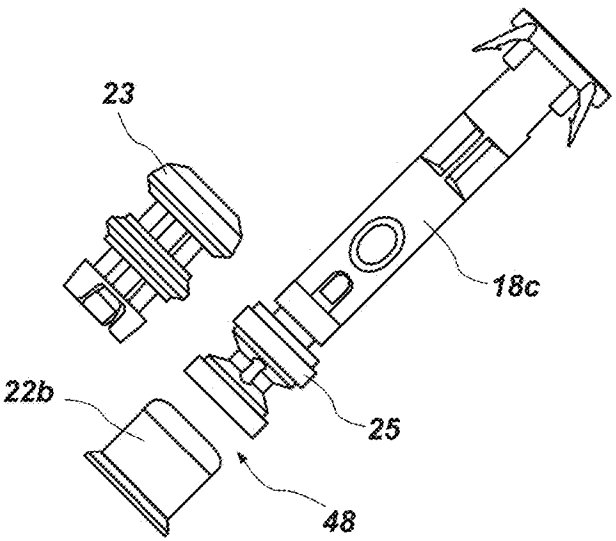
FIG. 7B is a side view of the assembly of FIG. 7A, with a pliable component of the slidable piston displaced from its position about a rigid component of the piston.
Figure 7A:
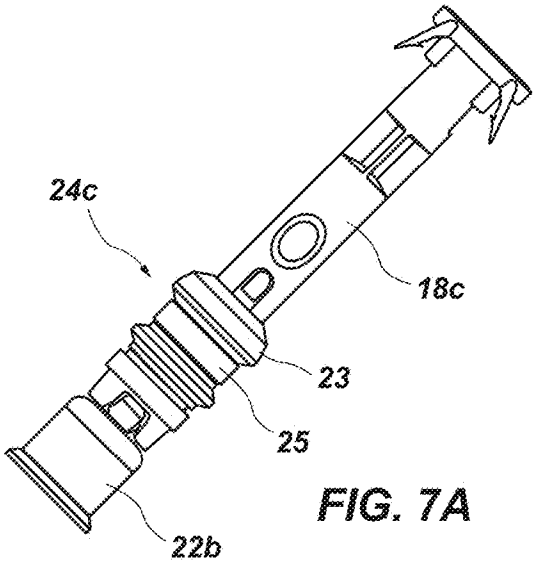
FIG. 7A is a side view of an anchor, a slidable piston and a pressure source in accordance with an embodiment of the technology.
Figure 7C:
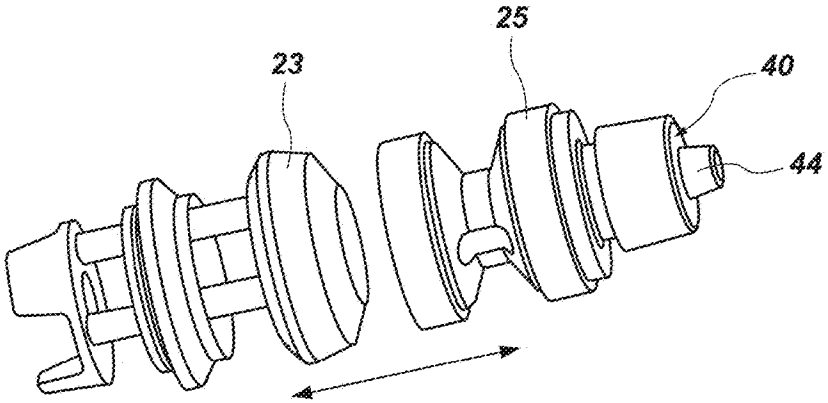
FIG. 7C is a perspective view of the slidable piston of FIG. 7B, with the pliable component displaced from its position about the rigid component.
Figure 8:
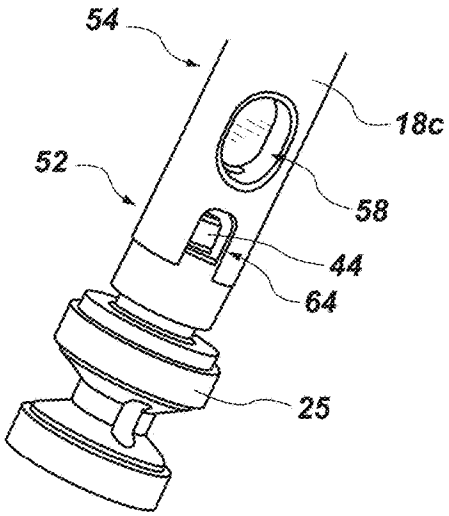
FIG. 8 is a perspective, partial view of a rigid component of a slidable piston positioned against an anchor in accordance with an embodiment of the technology.

As shown in more detail in FIGS. 7A through 7C, in one aspect of the technology, the slidable piston 24*c* can include a first, substantially rigid component 25 that can be formed from a material such as aluminum, steel, hardened composites, etc. The piston can also include a second, substantially pliable component 23. The pliable component can at least partially circumscribe the rigid component. In the views of FIGS. 7B and 7C, the pliable component is shown removed from the rigid component. Depending on the manner of applying the pliable component about the rigid component, however, physically separating the two as shown may not be practicable. While the pliable component can be formed in a manner that allows it to be slipped over or around the rigid component, in one example the pliable component can be formed about the rigid component during manufacture. In this case, physically separating the two and maintaining the pliable component intact may not be possible.

The pliable component can be formed from a variety of suitable materials, including without limitation, neoprene, Santoprene™, etc. These materials provide a relatively soft but tough article that remains pliable enough to allow the component 23 to create a seal with an inner diameter of the socket. This seal can be sufficient to maintain pressure zones behind and ahead of the piston, and will generally result in a fit that at least partially retards movement of the piston within the socket. In other words, the seal slightly resists movement of the piston within the socket such that the piston will generally remain in position within the socket until acted upon by the pressure wave generated by the pressure source 22*b*. While the piston will move freely once acted upon by the pressure wave, normal handling of a launcher, or the force of gravity, is typically insufficient to overcome the force applied by the seal.

Figure 6B:
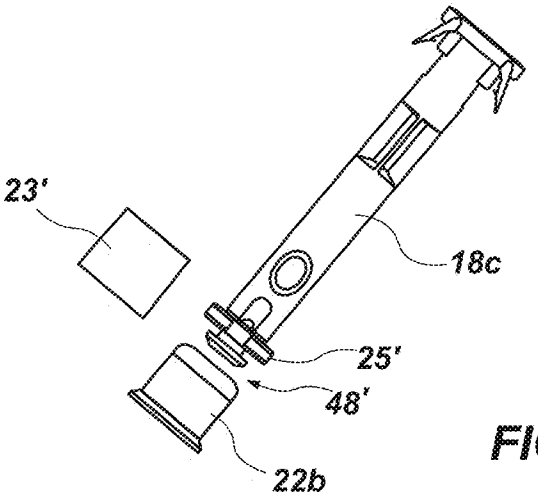
FIG. 6B is a side view of the assembly of FIG. 6A, with a pliable component of the slidable piston displaced from its position about a rigid component of the piston.
Figure 6A:
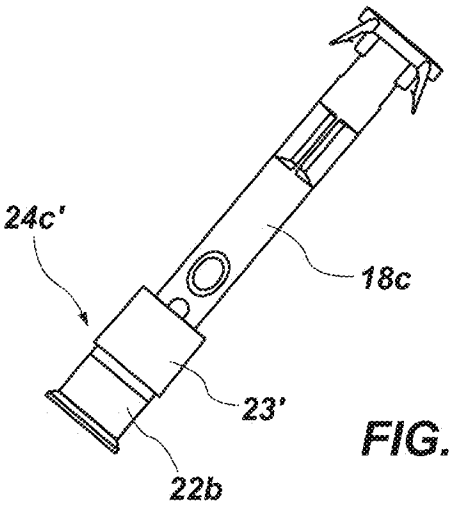
FIG. 6A is a side view of an anchor, a slidable piston and a pressure source in accordance with an embodiment of the technology.
Figure 6C:
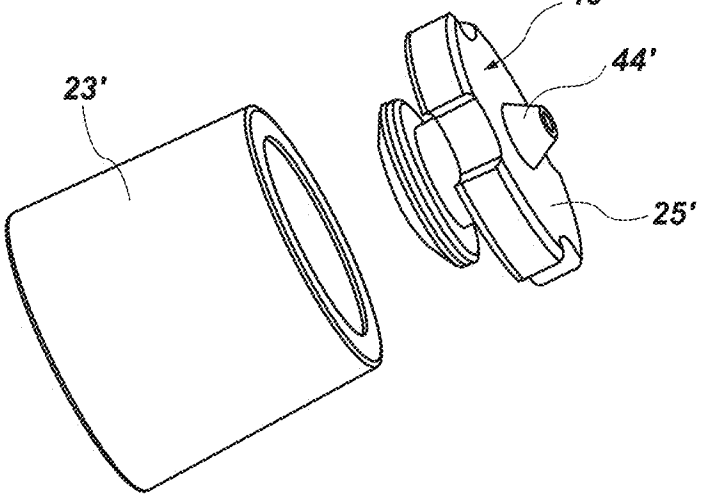
FIG. 6C is a perspective view of the slidable piston of FIG. 6B, with the pliable component displaced from its position about the rigid component.

FIG. 6A through 6C illustrate much the same features of 7A through 7C, except that in this embodiment the slidable piston 24*c*' is configured slightly differently than piston 24*c*. In this example, piston 24*c*' includes pliable component 23' and rigid component 25'. The various features described herein in relation to piston 24*c* also apply to piston 24*c*', for example, various alignment features, standoff features, etc., as discussed in further detail throughout this specification.

Returning now to FIG. 2D, this view includes the components of FIG. 2C, except that the pliable component 23 of the slidable piston 24*c* is omitted to provide a clearer view of the rigid component 25. FIG. 2E illustrates the cassette of FIG. 2D, except that the slidable piston is omitted from view.

Figure 3B:
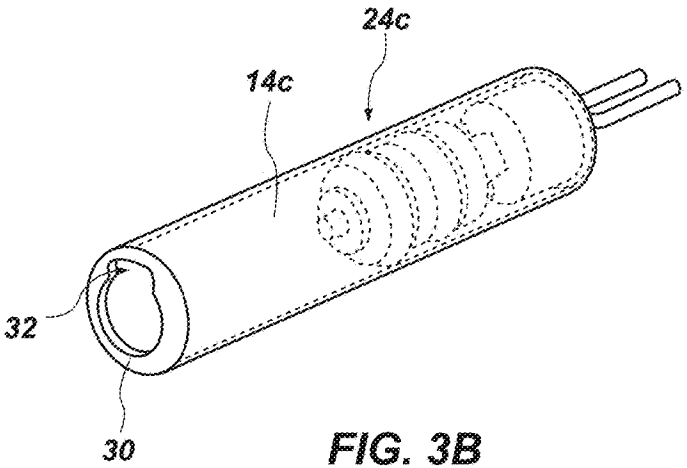
FIG. 3B is a perspective view of the socket of FIG. 3A, with an outer portion of the socket shown transparently to reveal inner components in more detail.
Figure 3A:
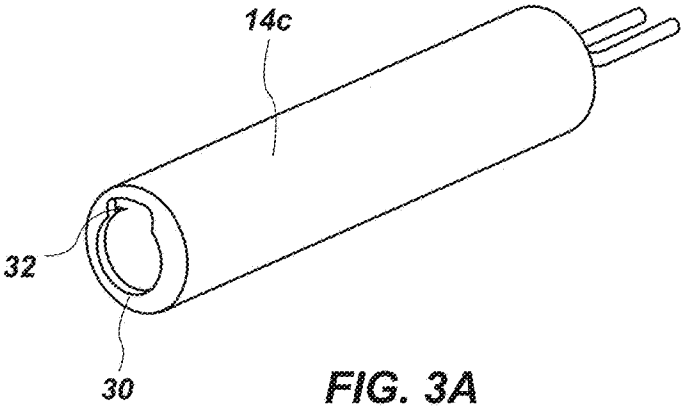
FIG. 3A is a perspective view of an exemplary socket in accordance with an embodiment of the technology.

As shown in FIGS. 3A and 3B, the socket 14*c* can include a piston stop 30 formed on or near an end thereof. The piston stop serves to prevent the piston 24*c* from exiting the socket during launch of the anchor 18*c* (not shown in this view). The piston stop can take a variety of forms, but in the example shown includes a lip extending radially inwardly into an end of the socket. The lip can be sized to allow the anchor to freely exit the socket, but serves to block the piston from exiting the anchor. In one embodiment, once fired, the assembly cannot be reused again, as either or both the piston and the piston stop are damaged by the impact of the piston and the stop during launch.

In one embodiment, the stop, e.g., lip 30, can extend only partially about a circumference of the socket 14*c*, so as to define a tether notch opening 32 therein. The opening 32 can serve several functions: in the examples shown (see FIG. 4, for example), the anchor 18*c* can include an anchor orientation protrusion 34 that can be alignable with the tether notch opening 32 in the lip while the anchor is installed in the socket. In this manner, the anchor can be installed through the lip 30 in only one orientation: this can ensure that the anchor is properly installed each time. In addition, as discussed in further detail below, the anchor orientation protrusion can also serve as a tether attachment that can receive and secure the tether therein.

Figure 4B:
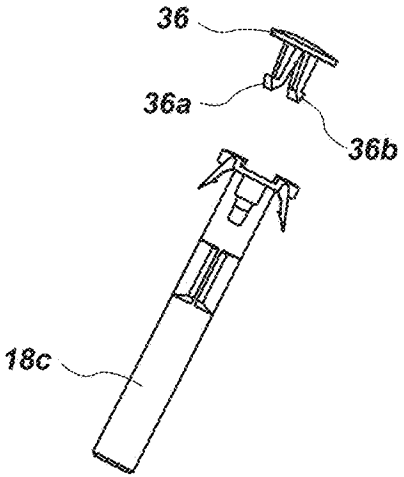
FIG. 4B is a perspective view of the anchor of FIG. 4A, with a retaining clip displaced from its position atop the anchor.
Figure 4A:
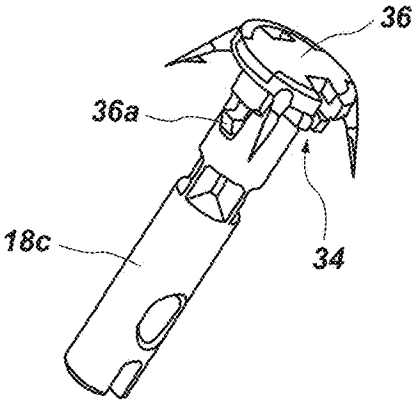
FIG. 4A is a perspective view of an exemplary anchor in accordance with an embodiment of the technology.

As shown in FIGS. 4A and 4B, a retaining clip 36 can be engageable with the anchor 18*c*, and also with the socket 14*c*. The retaining clip aids in retaining the anchor in the socket prior to generation of the pressure wave. The retaining clip can also ensure that both the anchor and the piston 24*c* are precisely positioned, and remain so, within the socket. In one example, when the retaining clip is installed, a slight pre-load is applied to the anchor and through the slidable piston atop the pressure source 22*b*. The pliable component 23 of the piston can aid in maintaining this pre-load, as the pliable component creates a slight resistant to movement within the socket and compresses slightly when displaced by the clip.

The retaining clip can ensure that the anchor is maintained in intimate contact with the piston during assembly, storage, haulage, etc. This intimate contact is maintained throughout operation of the launcher, up to the point where the anchor exits the socket while, as discussed below, the piston remains within the socket.

Figure 5:
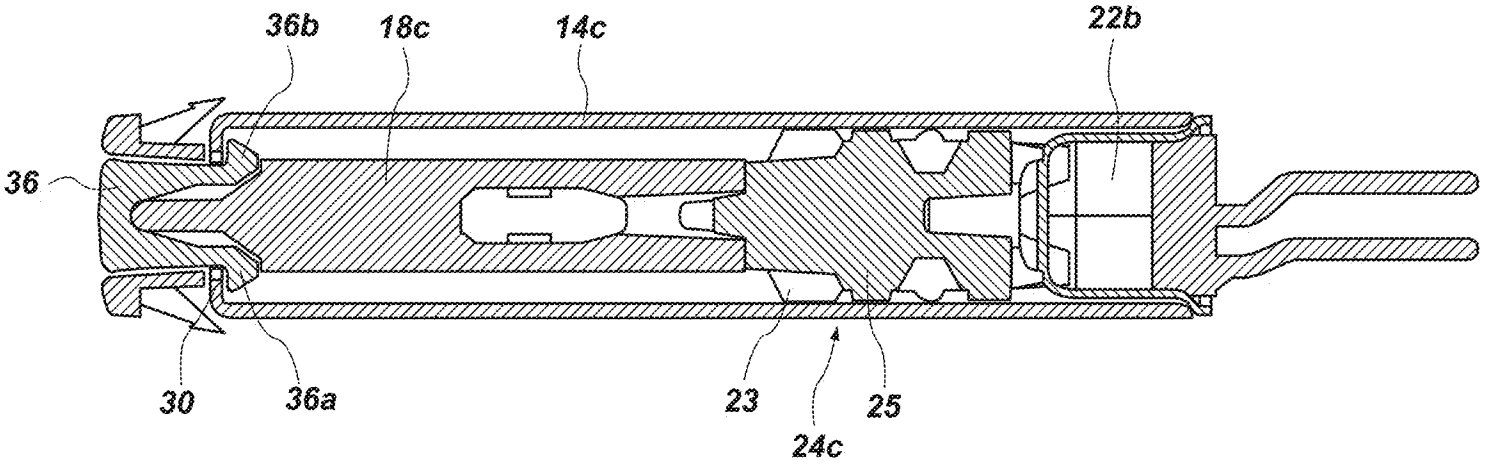
FIG. 5 is a side view of an exemplary socket in accordance with an embodiment of the technology, with outer components shown transparently to reveal inner components in more detail.

In the example of FIG. 5, the piston stop 30 positioned at the end of the socket 14*c* can be used to retain the retaining clip 36 in position within the socket. In this example, the retaining clip includes two pliable arms 36*a*, 36*b*, that can be biased inward during installation to allow the clip to be installed, then spring outward when released to engage the inner surface of the retaining lip. The retaining clip can be formed from a sacrificial material, such as plastic, so that the retaining clip does not interfere with proper launch of the anchor. Once the pressure wave is applied to the anchor, the retaining clip can be destroyed as the anchor exits the socket. The retaining clip can be formed from a variety of materials, including polycarbonate, ABS, POM/Delrin, and the like, and blends thereof.

Generally speaking, the present technology advantageously provides various manners of orienting and aligning the anchor, slidable piston, retaining clip and pressure source within the socket. In one example, the piston and anchor can be configured such that a portion of the rigid component of the piston is seated against a portion of the anchor when the anchor and piston are positioned within the socket. As shown for example in FIGS. 6C and 7C, respectively, rigid piston component 25' and 25 each include a contact surface 40 that makes direct contact with a contact surface 42 of anchor 18*c* (see FIG. 9, for example). In this manner, the slidable piston can immediately begin transferring force to the anchor when the piston is subject to the pressure wave. The retaining clip, discussed above, can aid in maintaining the components in this position prior to launch.

Figure 9:
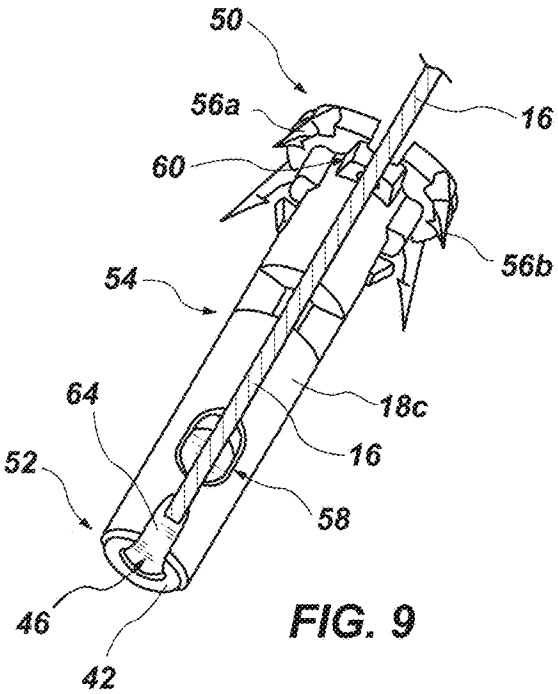
FIG. 9 is a perspective view of an anchor having a tether extending along a length thereof in accordance with an embodiment of the technology.

The rigid component 25', 25, respectively, of the slidable piston 24', 24, can include an alignment feature 44', 44, as can the anchor 18*c* (see feature 46 in FIG. 9). These respective alignment features can be engageable with one another when the anchor and piston are positioned within the socket to ensure proper alignment of the anchor within the socket. While the alignment features can take a variety of forms, in one embodiment, the alignment feature 44', 44 of the piston 24*c*', 24*c*, respectively, can include a pin and the alignment feature 46 (FIG. 9) of the anchor 18*c* can include a pocket. The pin can be fittable within the pocket to ensure that the anchor is properly aligned relative to the slidable piston. The slidable piston can be maintained in alignment by the outer seal portion of the pliable component 23', 23 of the slidable piston. In these examples, these alignment features can ensure that both the piston and the anchor are concentrically centered within the socket when the pin is fitted within the pocket.

While the anchor and the rigid component of the piston are held in direct contact prior to initiation of the launcher, the rigid component of the piston and the pressure source can be maintained slightly spaced from one another. In one example, a portion of the pliable component of the piston can be seated against the pressure source so as to create a standoff space between the rigid component of the piston and the pressure source when the anchor and piston are positioned within the socket. This can be seen, for example, in FIG. 6B, where a standoff space 48' is maintained between pressure source 22*b* and the rigid component of the 25' of the piston. This space is maintained by the pliable component 23' of the piston. Similarly, in FIG. 7B, it can be seen that a standoff space 48 is maintained between pressure source 22*b* and the rigid component 25 of the piston. While this distance can vary, in one example the standoff space is about 1 mm. In another example, the standoff space is about 2 mm. In another example, the standoff space can be from about 0.5 mm to about 3 mm.

FIGS. 8 through 11 illustrate further exemplary embodiments of the technology. In these examples, the anchor 18*c* can include a head segment 50, a tail segment 52, and a shank segment 54 intermediate the head and tail segment. One or more hook segments 56*a*, 56*b*, etc., can be carried adjacent the head segment. The one or more hook segments can be operable to engage the person of a subject about which the entangling projectile has been deployed. An attachment bay 58 can be formed in the shank segment. A tether 16, 16' can be coupled to the anchor within and can extend from the attachment bay. The tether can be coupled within the attachment bay in a variety of manners, including by application of adhesive, forming a knot or other obstruction in the tether, permanent deformation of the attachment bay or portions of the anchor body (crimping), etc.

In the example of FIG. 9, the anchor 18*c* can include a tether attachment 60 carried by the anchor distally from the attachment bay 58. The tether attachment can be operable to engage the tether 16 and maintain the tether in a taught condition between the tether attachment and an end (e.g., near tail segment 52) of the anchor. The tether attachment feature can ensure proper management of the tether as the tether is attached to the anchor, as the anchor is installed within the socket, and as the anchor is deployed from the socket during launch.

Figure 10:
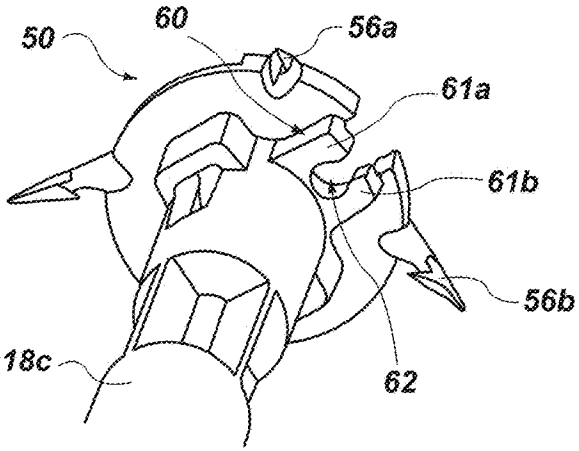
FIG. 10 is a more detailed view of a tether attachment of the anchor of FIG. 9.

As best seen in FIG. 10, the tether attachment 60 can include a pair of arms 61*a*, 61*b* that define an internal receiving space, 62. A distance between ends of the pair of arms can be smaller than an internal diameter of the internal receiving space 62. In this manner, the tether can be forced between the arms 61*a*, 61*b* until it clears this space and enters the internal receiving space. Once thus positioned, the arms resist movement of the tether out of this space. In one embodiment, the internal diameter of the internal receiving space substantially corresponds to, or is smaller than, an external diameter of the tether. In this manner, the tether can be securely cinched within the receiving space.

As seen in FIG. 9, this embodiment can also include a tether port 64 that can be in communication with the attachment bay 58 to allow the tether to extend from the attachment bay to the tether port and extend from the tether port toward the tether attachment 60. Thus, the tether can be coupled to the anchor within the attachment bay, and can extend through the tether port and upward along the side of the anchor. In this manner, the tether can be securely attached coaxially or concentrically to the anchor, but can extend laterally adjacent the anchor as it extends out of the socket. This attachment scheme advantageously allows this tether management without interfering with the contact fit between the anchor and the rigid portion of the slidable piston.

For example, while the tether is omitted from view from 8, it will be appreciated that the path traversed by the tether from the attachment bay 58, through the tether port 64 allows the tether to be fed away from the attachment bay without interfering with the fit between the pin 44 of the piston and the pocket 46 (FIG. 9) of the anchor. In this manner, a centric opening can be formed in an end of the tail segment of anchor, and the tether can extend from the attachment bay and out of the tether port without traveling through the centric opening. While not so required, in the examples shown in the drawings, the attachment bay can be open only one side of the shank segment of the anchor. This can aid in securing the tether within the bay without adhesive or portions of the tether extending through the other side.

Figure 11:
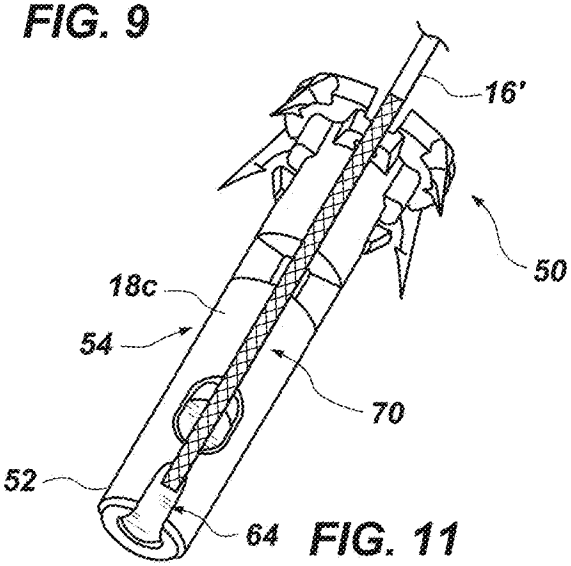
FIG. 11 is a perspective view of an anchor having a tether extending along a length thereof in accordance with another embodiment of the technology.

As shown in FIG. 9, the tether attachment 60 provides a manner by which the tether 16 can be maintained in a substantially taught configuration adjacent the anchor 18*c* while being installed within the socket, and while stored in the socket prior to launch. FIG. 11 illustrates another embodiment by which this can be achieved. In this example, a stiffening agent (shown schematically at 70) can be applied to, or carried by, the tether 16' in a location adjacent the anchor. The stiffening agent can aid in maintaining the tether is a substantially taught configuration as it extends along the shank segment of the anchor. The stiffening agent can be applied in addition to, or instead of, using the tether attachment.

The stiffening agent can be carried by the tether only in an area between opposing ends of the anchor: in other words, the portion of the tether that extends from the attachment bay 58 and turns while exiting the tether port 64 can be left untreated, so as to remain flexible. Similarly, the portion of the tether that extends away from the anchor toward an opposing anchor can remain flexible as well.

The type of stiffening agent used can vary, but in one embodiment can be a chemical agent, such as a curable and/or hardenable adhesive, applied to the tether which thereby increases a stiffness of the tether. The stiffening agent can also include a mechanical agent applied to the tether to increase a stiffness of the tether. This can include, for example, strands of a stiffer material, such as wire strands, or a sheath of stiffer material, such as a woven wire shield.

FIGS. 12 through 17 illustrate various additional embodiments of the technology in which the piston is formed in different configurations and/or from differing materials than the embodiments discussed previously. Generally, as used herein, the terms "pliable" and "rigid" are relative terms. In the examples provided above, the pliable component of the piston can be a material that can be easily compressed, such as, for example, neoprene, Santoprene™, etc. However, in some embodiments, the relatively pliable material can be selected from materials such as more rigid thermoplastics, material sold under the tradename Delrin (Polyoxymethylene, or POM), and the like. These materials, while relatively soft compared to metals such as steel, are not easily compressed at room temperature. Thus, while such materials are referenced herein as "relatively pliable," such reference is made relative to another material, often a much more rigid material, such as steel.

Figure 12:
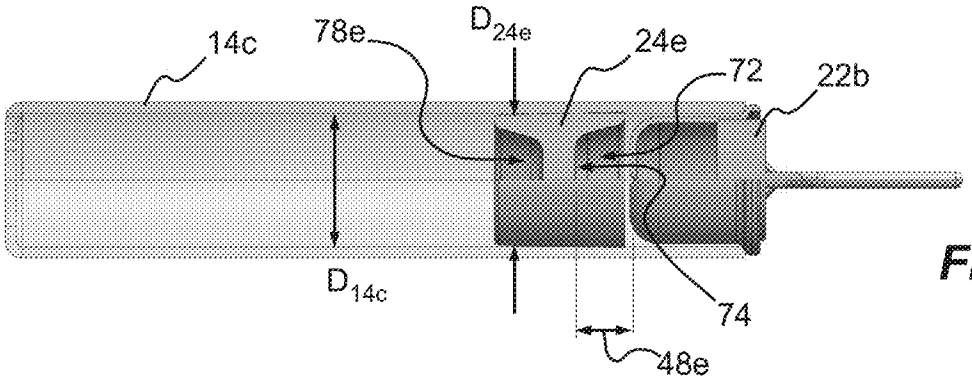
FIG. 12 is a side, partially sectioned view of a socket carrying a piston and a pressure source in accordance with an embodiment of the technology.

In the example shown in FIG. 12, the piston 24*e* is monolithic (e.g., formed from a single material). It can be formed from a relatively pliable material, such as Delrin, a thermoplastic, or the like. In this example, the piston includes an outer diameter $D_{24e}$ that is larger than an inner diameter $D_{14c}$ of the socket 14*c*. In this manner, engagement between the outer diameter of the piston and the inner diameter of the socket partially retards movement of the piston within the socket. That is, once installed in position within the socket, the piston will not easily move during manufacture, storage, haulage, etc. However, once the pressure source 22*b* is activated, the piston will be propelled freely down the socket.

The degree of difference between the outside diameter $D_{24e}$ of the piston 24*e* and the inside diameter $D_{14c}$ of the socket 14*c* can vary. In one embodiment, however there is an interference of about 1.83% between the two. This interference fit can range, in other embodiments, from about 0.5% to about 4.0%. In one example, the nominal inner diameter $D_{14c}$ is about 8.2 mm and the nominal outside piston diameter $D_{24e}$ is about 8.35 mm, resulting in the 1.83% interference fit. In one example, the socket 14*c* can be formed from stainless steel, such as 304 L, with a wall thickness of around 0.56 mm. Suitable ranges of wall thickness can vary from about 0.25 mm to about 2.0 mm. This fit can advantageously allow the piston to be precisely positioned where desired during assembly. In some embodiments, the socket, as that term is used herein, can include a laser welded assembly that includes a MicroGas Generator Assembly ("MGGA"): e.g., the socket assembly as a whole can include a launch tube and a MGG (MicroGas Generator) pressure source.

In some embodiments of the technology discussed above, a portion of the piston is placed in intimate contact with the pressure source during assembly. This can allow the creation of a standoff distance or space between a portion of the piston and an end of the pressure source (see, e.g., 48 in FIG. 7B). In some embodiments, however, for example some of those shown in FIGS. 12-17, the piston can include a pressure receiving cup 72 that can include a floor surface 74 (e.g., a surface at the floor of the cup, if viewed in an upright position). The floor surface of the pressure receiving cup can be spaced from an end of the pressure source 22*b* to create a standoff space (48*e*, for example, in FIG. 12) between the floor surface of the pressure receiving cup and the pressure source when the anchor and piston are positioned within the socket. In some embodiments, this standoff space is between about 1 mm and about 2 mm.

Figure 13:
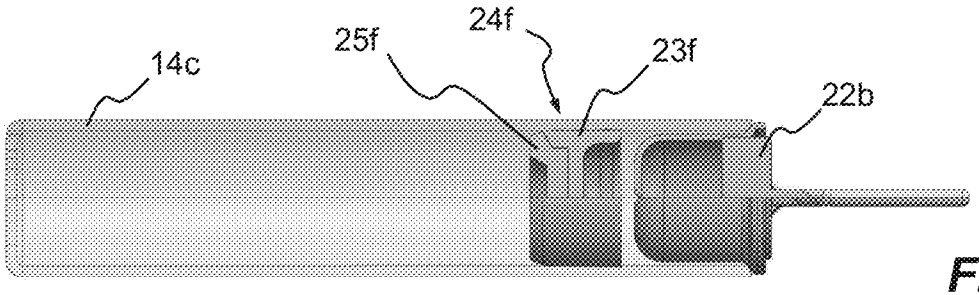
FIG. 13 is a side, partially sectioned view of a socket carrying a piston and a pressure source in accordance with another embodiment of the technology.

The floor surface of the pressure receiving cup of the piston can be shaped in a variety of configurations, including a generally bowl-shaped or rounded depression. It can also include a generally planar surface, as shown in FIG. 13, for example. The sidewalls forming the cup can extend substantially completely around the bowl, or can include openings or gaps therein (similar to the embodiment shown in FIG. 7C).

The interference fit between the outside diameter of the piston and the inside diameter of the socket can advantageously allow the standoff space to be precisely configured, without requiring that a portion of the piston be installed in intimate contact with a portion of the pressure source. While the drawings provided herewith are not necessarily drawn to scale, and do not necessarily show components precisely spaced relative to one another, FIGS. 12-17 illustrate exemplary spacings of pistons 24*e*, 24*f*, 24*g*, etc., relative to the pressure source 22*b*.

Figure 14:
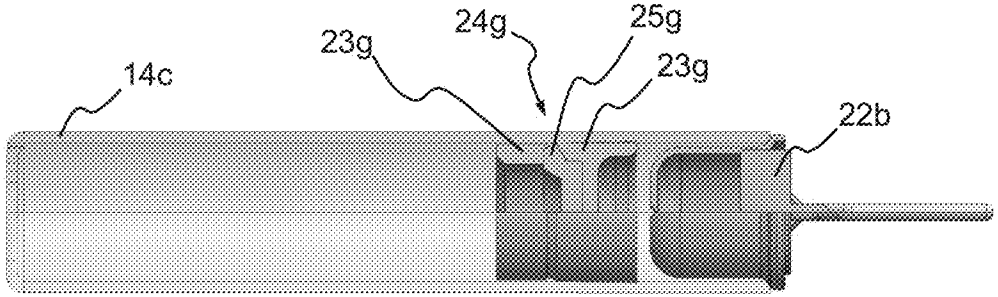
FIG. 14 is a side, partially sectioned view of a socket carrying a piston and a pressure source in accordance with another embodiment of the technology.
Figure 15:
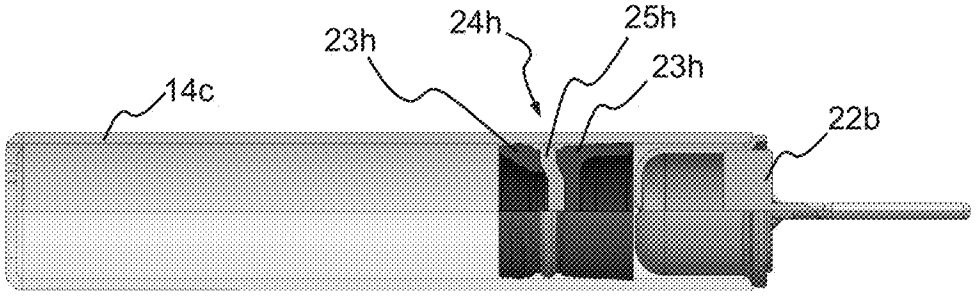
FIG. 15 is a side, partially sectioned view of a socket carrying a piston and a pressure source in accordance with another embodiment of the technology.
Figure 16:
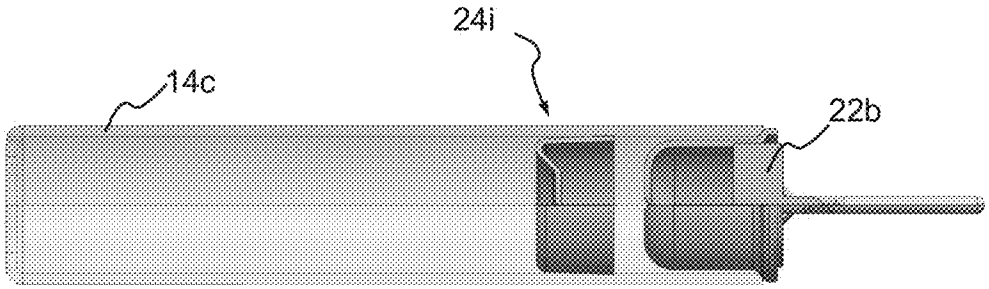
FIG. 16 is a side, partially sectioned view of a socket carrying a piston and a pressure source in accordance with another embodiment of the technology.
Figure 17:
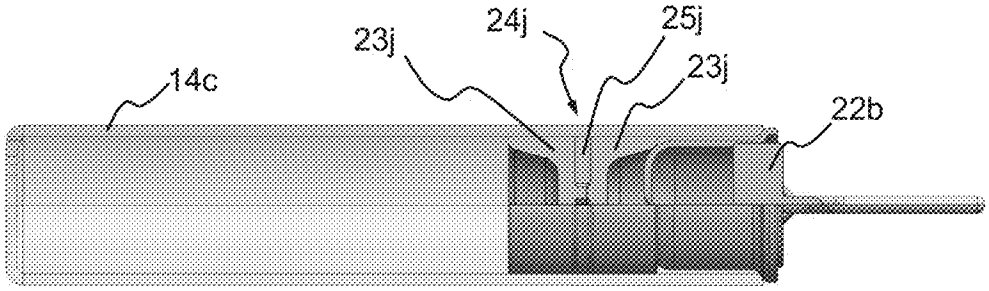
FIG. 17 is a side, partially sectioned view of a socket carrying a piston and a pressure source in accordance with another embodiment of the technology.

In the example of FIG. 13, piston 24*f* includes a first, relatively pliable component 23*f* and a second, relatively rigid component 25*f*. In the example of FIG. 14, piston 24*g* includes a first and second relatively pliable components 23*g* and a third, relatively rigid component 25*g*. In the example of FIG. 15, piston 24*h* includes first and second relatively pliable components 23*h* and a third, relatively rigid component 25*h*. In the example of FIG. 16, piston 24*i* is formed from a single material, typically a metallic material such as steel. In the example of FIG. 17, piston 24*j* includes a first, relatively pliable component 23*j* and a second, relatively rigid component 25*j*.

Where pistons are described above having multiple components, such components can be coupled one to another, can be formed integrally with one another, or can be mechanically interwoven one with another to maintain the piston components together as a unit.

Figure 18:
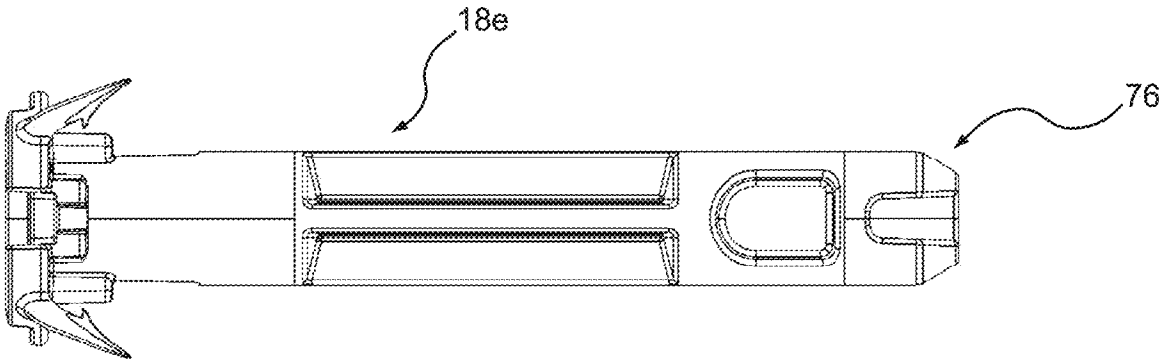
FIG. 18 is a side view of another anchor in accordance with an embodiment of the technology.

FIG. 18 illustrates a further embodiment of an anchor 18*e* in accordance with an embodiment of the technology. In this example, the anchor includes a tapered end 76 that includes a reduced diameter relative to an adjacent portion of the shank of the anchor. In this embodiment, the end 76 of the anchor can serve as the alignment feature of the anchor. Each of the piston embodiments illustrated in FIGS. 12-17 include a cup or pocket portion (one is identified, for example, at 78*e* in FIG. 12). The cup or pocket portion of the piston can serve as the alignment feature of the piston. Thus, the tapered or reduced diameter portion of the anchor can fit within the pocket or cup portion to precisely align the anchor relative to the piston.

In addition to the structure outlined above, the present technology also provides various methods of using, manufacturing, assembling and configuring various projectile launchers, sound reducing or dampening components and the like, including without limitation various methods of aligning anchors relative to sockets and pistons, methods of arranging tethers within cassettes, methods of attaching tethers to anchors, and the like.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. A cassette for deploying one or more entangling projectiles, the cassette comprising:

a pair of sockets, each socket being in fluid communication with a pressure source;

an entangling projectile including a pair of anchors connected by a tether, each of the pair of anchors being positionable within one of the sockets and the tether being carried by the cassette;

each socket carrying a slidable piston positionable in a respective socket between an entangling projectile and the pressure source such that each slidable piston is propelled along a respective socket in response to a pressure wave generated by the pressure source to thereby expel the anchor from the socket; and a piston stop positioned at an end of each socket, each piston stop preventing a respective piston from exiting a respective socket, the piston stops each including a lip extending radially inwardly into an end of each respective socket, each lip extending only partially about a circumference of each respective socket, so as to define a tether notch opening therein.

2. The cassette of claim 1, wherein each anchor includes an anchor orientation protrusion alignable with a respective tether notch opening in a respective lip while a respective anchor is installed in a respective socket.

3. The cassette of claim 1, wherein each piston includes a first, relatively rigid component coupled to a second, relatively pliable component, the pliable component having an outer diameter greater than an inner diameter of the socket, engagement between the outer diameter of the pliable component and the inner diameter of a respective socket partially retarding movement of a respective piston within a respective socket.

4. The cassette of claim 1, further comprising a pair of retaining clips, each engageable with an anchor and with a socket to aid in retaining the respective anchor in the respective socket prior to generation of the pressure wave.

5. The cassette of claim 4, wherein each socket includes a piston stop positioned at an end of the socket, the piston stops preventing a respective piston from exiting a respective socket, and wherein each retaining clip includes at least one arm that engages a respective piston stop.

6. The cassette of claim 4, wherein each retaining clip is formed from a sacrificial material.

7. The cassette of claim 6, wherein each the retaining clip is formed from plastic.

8. A cassette for deploying one or more entangling projectiles, the cassette comprising:

a pair of sockets, each socket being in fluid communication with a pressure source;

an entangling projectile including a pair of anchors connected by a tether, each of the pair of anchors being positionable within one of the sockets and the tether being carried by the cassette;

each socket carrying a slidable piston positionable in a respective socket between an entangling projectile and the pressure source such that each slidable piston is propelled along a respective socket in response to a pressure wave generated by the pressure source to thereby expel the anchor from the socket; and a pair of retaining clips, each engageable with an anchor and with a socket to aid in retaining the respective anchor in the respective socket prior to generation of the pressure wave;

each socket including a piston stop positioned at an end of the socket, each piston stop preventing a respective piston from exiting a respective socket, and wherein each retaining clip includes at least one arm that engages a respective piston stop.

9. The cassette of claim 8, wherein each retaining clip includes a pair of arms that each slidably engage one of a pair of sloped pockets formed in a respective anchor.

10. The cassette of claim 8, wherein each retaining clip is formed from a sacrificial material.

11. The cassette of claim 10, wherein each retaining clip is formed from plastic.

12. The cassette of claim 8, wherein each piston stop includes a lip extending radially inwardly into an end of a respective socket.

13. The cassette of claim 12, wherein each lip extends only partially about a circumference of a respective socket, so as to define a tether notch opening therein.

14. The cassette of claim 13, wherein each anchor includes an anchor orientation protrusion alignable with a respective tether notch opening in a respective lip while a respective anchor is installed in a respective socket.

15. The cassette of claim 14, wherein each anchor orientation protrusion engages the tether when a respective anchor is installed in a respective socket.

16. The cassette of claim 8, wherein each piston includes a first, relatively rigid component coupled to a second, relatively pliable component, one of the pliable component or the rigid component having an outer diameter greater than an inner diameter of a respective socket, engagement between the outer diameter of the anchor and the inner diameter of the socket partially retarding movement of a respective piston within a respective socket.

* * * * *